US010494071B2

(12) United States Patent
Serre

(10) Patent No.: US 10,494,071 B2
(45) Date of Patent: Dec. 3, 2019

(54) SEGMENTED RIGID SAIL

(71) Applicant: Gilles Serre, Yerres (FR)

(72) Inventor: Gilles Serre, Yerres (FR)

( * ) Notice: Subject to any disclaimer, the term of this patent is extended or adjusted under 35 U.S.C. 154(b) by 0 days.

(21) Appl. No.: 15/779,715

(22) PCT Filed: Nov. 28, 2016

(86) PCT No.: PCT/FR2016/000195

§ 371 (c)(1),
(2) Date: May 29, 2018

(87) PCT Pub. No.: WO2017/093619

PCT Pub. Date: Jun. 8, 2017

(65) Prior Publication Data

US 2019/0193825 A1 Jun. 27, 2019

(30) Foreign Application Priority Data

Nov. 30, 2015 (FR) ..... 15 02491

(51) Int. Cl.
*B63H 9/06* (2006.01)

(52) U.S. Cl.
CPC ... *B63H 9/0607* (2013.01); *B63H 2009/0621* (2013.01); *B63H 2009/0635* (2013.01)

(58) Field of Classification Search
CPC ..... B63H 9/06; B63H 9/0607; B63H 2009/0621; B63H 2009/0635
See application file for complete search history.

(56) References Cited

U.S. PATENT DOCUMENTS

| | | | | |
|---|---|---|---|---|
| 1,504,057 A * | 8/1924 | Koelkebeck | ..... | B63H 9/06 114/39.32 |
| 3,403,653 A | 10/1968 | Bush | | |
| 4,453,483 A * | 6/1984 | Shallenberger | ..... | B63H 9/0607 114/102.16 |
| 4,465,008 A * | 8/1984 | Liggett | ..... | B63B 1/14 114/102.16 |
| 4,582,013 A * | 4/1986 | Holland, Jr. | ..... | B63H 9/02 114/39.3 |
| 4,895,091 A | 1/1990 | Elmali | | |

(Continued)

FOREIGN PATENT DOCUMENTS

| | | |
|---|---|---|
| FR | 1 300 180 | 8/1962 |
| FR | 2 662 660 | 12/1991 |
| FR | 3001437 | 8/2014 |

*Primary Examiner* — Stephen P Avila
(74) *Attorney, Agent, or Firm* — Horst M. Kasper, Esq.

(57) ABSTRACT

The invention relates to a "wing" type rigid sail fragmented into independent segments, where general principle involves diving the rigid sail into different segments that can position themselves independently from neighboring segments, depending on the wind received, with the profile of the sail controlled following two independent but complementary methods, where the segments at the front of the sail are linked together by their front flap, through a process that allows adjusting their relative freedom, playing on the angle that each segment can take compared to neighboring segments, and on the back of the "sail sheet", the rope allowing sail adjustment links each segment by its back flap, top to bottom, allowing for adjustment of the opening up of the sail while keeping the desired flexibility of the sail.

1 Claim, 4 Drawing Sheets

(56) References Cited

U.S. PATENT DOCUMENTS

| | | | | |
|---|---|---|---|---|
| 2013/0014683 | A1* | 1/2013 | Hoyt | B63H 9/0607<br>114/102.13 |
| 2016/0083063 | A1* | 3/2016 | Widnall | B63H 9/0607<br>114/102.22 |

* cited by examiner

SEGMENTED RIGID SAIL

The current invention is based on a new approach of a boat sail, based on a «wing» type rigid sail fragmented, into independent segments.

Currently used a «wing» type sails on the last generation of sailboats have disadvantages such as too high rigidity, impossibility to be lowered, meaning the ability to reduce the area exposed to the wind, hence inducing specific handling quite far from traditional sailing. For a team specifically trained on this type of sail, it must manage front and back flaps and adjust the twist of the sail by mechanical torsion. And, to be lowered, the sail must be dismantled, which, can only be achieved once back to the harbor, with specific craning equipment. The precedent patent n° FR13 00180 (N° and issue date: FR3001437—2014 Aug. 1 [BOPI 2014-31]) aimed at describing a process allowing the reduction of a rigid sail area. The implementation of different prototypes linked to that patent lead us to consider today the new proposed sail as a new approach to the rigid sail.

The invention device allows remedying all disadvantages of the rigid sail, while simplifying maneuvers. The sail is composed of overlapping rigid sail segments, each segment preserving the «wing» sail characteristics, while remaining independent from the other segments. The profile of the sail is controlled following two independent but complementary methods. At the front of the sail, segments are linked together by their front flap, through a process that allows adjusting their relative freedom, playing on the angle that each segment can take compared to other segments. On the back, the a «sail sheet», the rope allowing sail adjustment, links, each segment by its back flap, top to bottom, allowing the adjustment of the opening up of the sail while keeping the desired flexibility of the sail.

That sail configuration also enables managing the upwind sail area as described by patent n° FR13 00180.

Figure 1:
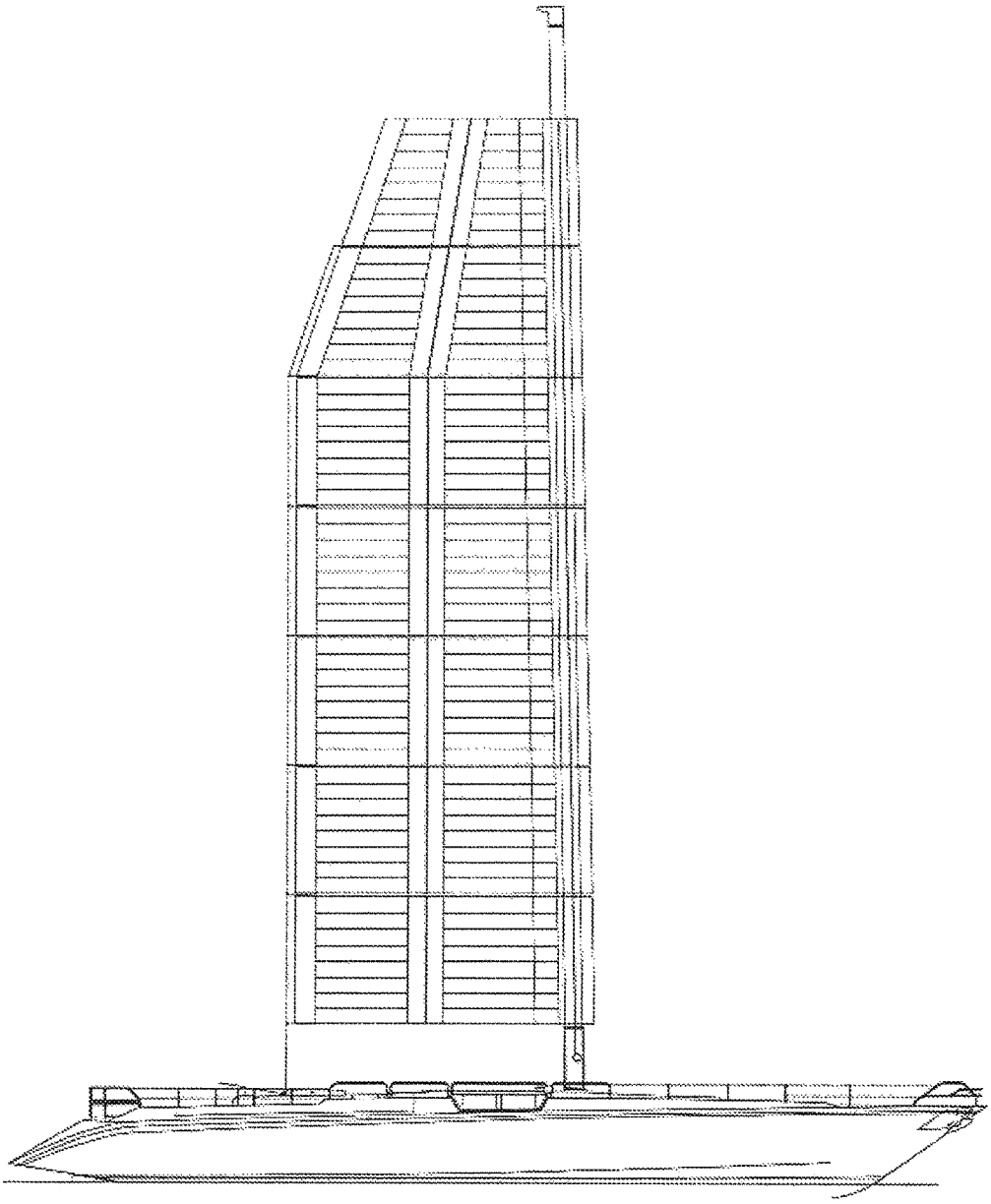

Annexed drawings illustrate the invention:

FIG. 1 displays an overview of the device mounted on a sailing boat.

Figure 2:
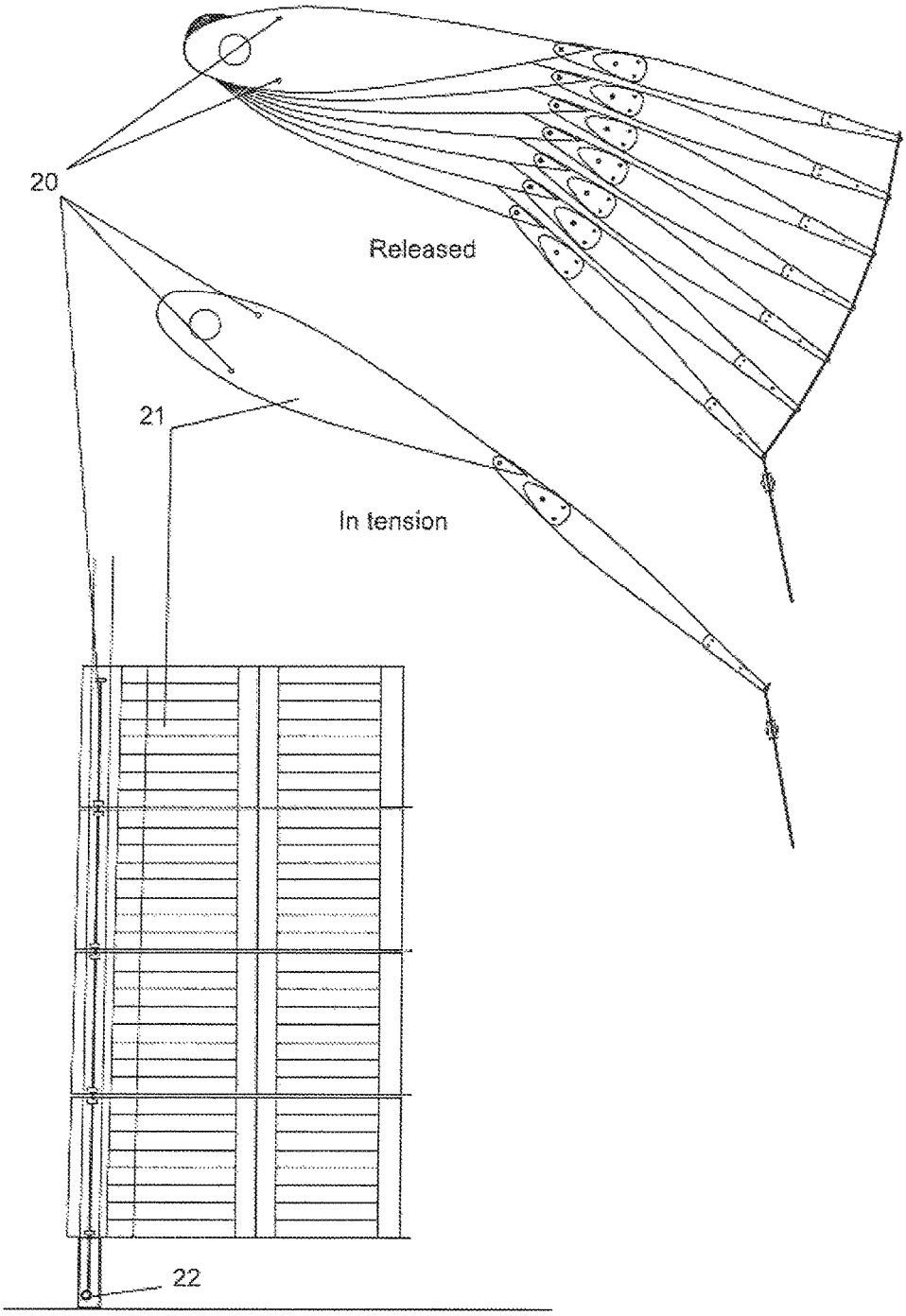

FIG. 2 details the adjustment of inter-segments freedom of movement.

Figure 3:
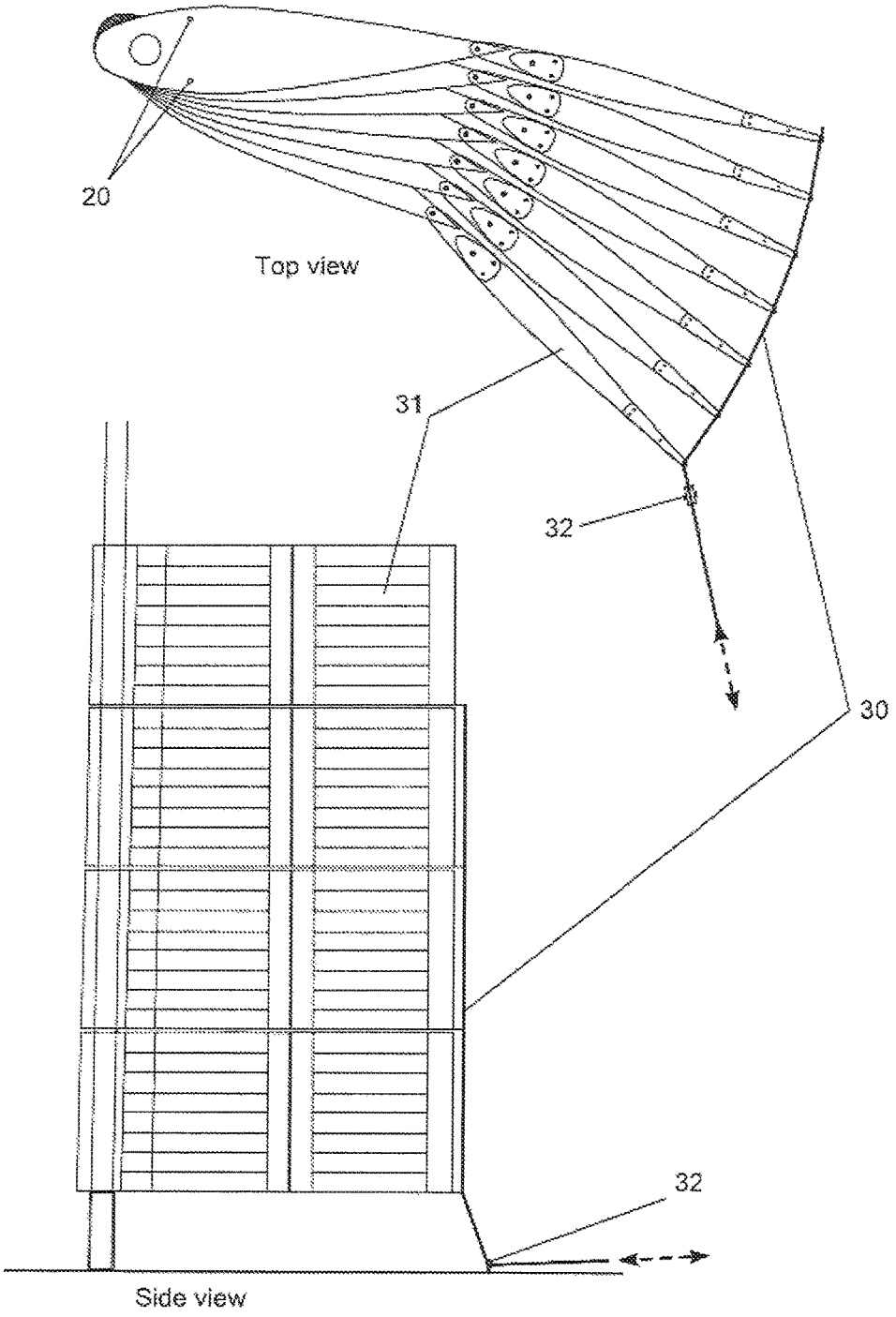

FIG. 3 details the sail adjustment in operation, using the a «sail sheet»

Figure 4:
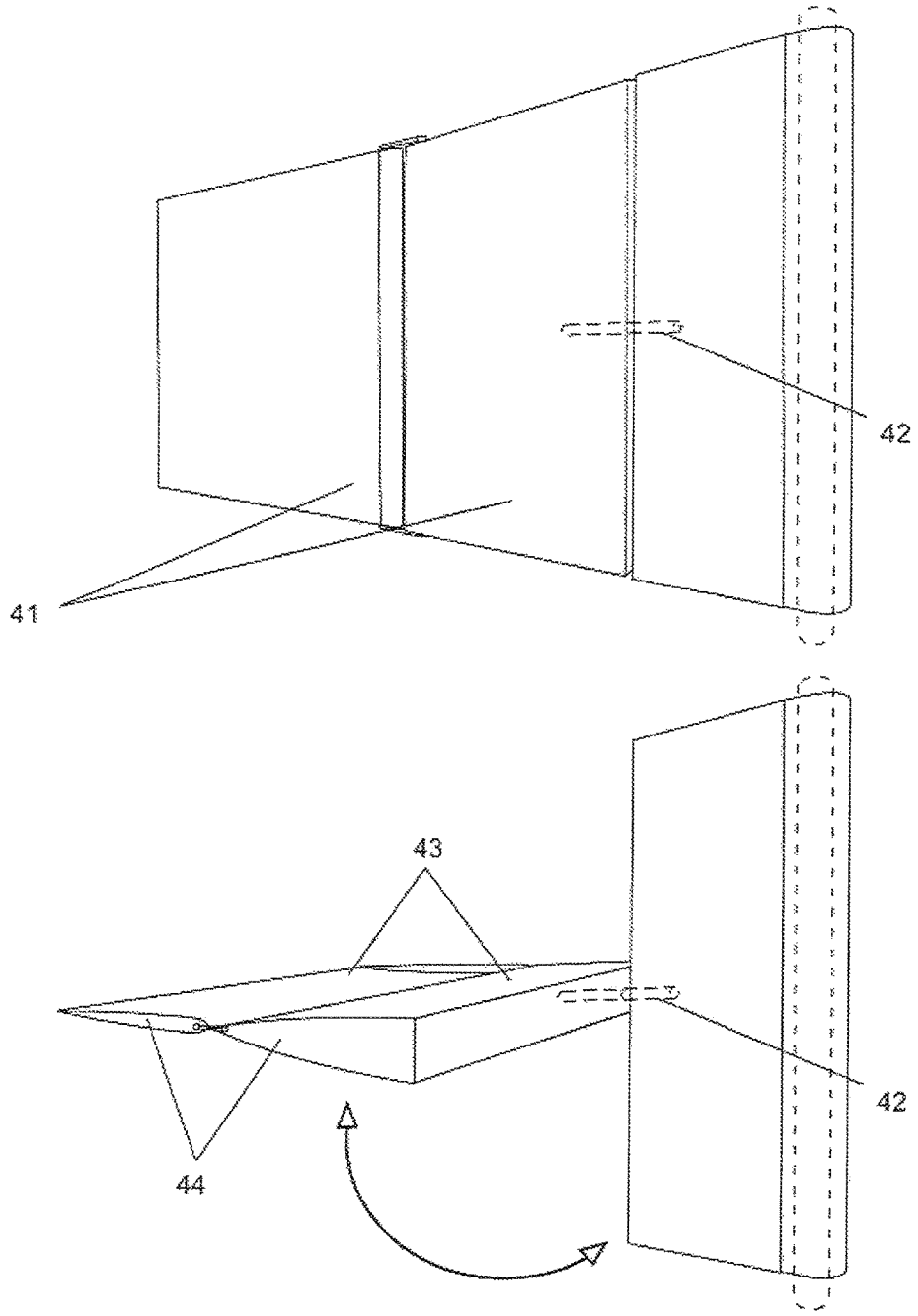

FIG. 4 reminds the functioning of reducing/increasing upwind sail area as described by patent n° FR13 00180.

Adjustment of sail inter-segments freedom of movement (FIG. 2)

The general principle of that new sail consists in dividing the rigid sail into different segments that can position themselves independently from the neighboring segments, depending on the wind received, However, and in order to keep global coherence to the sail, those different segments are linked together by their front flap (21). For small size boats, that link is realized, by means of a simple system of cables (20), passing by each segment and whose tensions adjust their relative freedom, by wrapping around a winch drum (22). For bigger size vessels, that adjustment can be realized by means of any appropriate mechanical and/or electromechanical system.

Adjustment of the working sail (FIG. 3)

Being able to move with a sail requires managing both its orientation, considering wind and boat proper directions, but also its power adjustment, determining factor of the boat speed. These adjustments are made through the «sail sheet» (30), the rope that links each segment by its back flap (31). Trim of the sail is then done like on a traditional sailing boat, by tension/release of the mainsheet passing through a pulley (32) attached to the boat deck.

Reduction/increase of a segment upwind sail area (FIG. 4)

Sail fragmentation also allows hoisting and reefing the sail, allowing upwind sail area to vary. Segment reduction system consists, not in removing sail area, just as done on a traditional sail, but to modify its orientation rendering it inoperative. To this end, each segment of sail (41) will be able to carry out a rotation on the horizontal plane, around an axis located in the middle (42), in a way to show not its surface (43), but its section (44) to the wind. Hence, the wind will have no more effect than, on a piece of traditional rigging (mast, boom . . . ). The increase of surface relies on the reverse process for each segment.

For a full description of the functioning refer to patent n° FR13 00180.

The invention device offers to the rigid sail the elements of flexibility and maneuverability to simplify its use at sea. It should, indeed, enable democratizing the use of the «wing» sail and get it out of the only high competition field to make it enter in areas as various as pleasure boating or maritime transport.

The invention claimed is:

1. A segmented "Wing" type rigid sail, consisting of horizontal fragmentation of the sail into independent segments, each segment preserving the "wing" sail characteristics, wherein sail coherence is assured by linking segments by their front flaps (21) through a process allowing adjustment of their relative freedom, playing on an angle that each segment can take in relation to neighboring segments wherein for small size boats that link is realized by means of a simple system of cables (20), passing by each segment and whose tensions, by wrapping around a winch drum (22), adjusting their relative freedom, wherein for bigger size vessels that adjustment can be realized by means of any appropriate mechanical and/or electromechanical system, wherein sail handling , that is its orientation and power, is achieved through the "sail sheet" (30) , a rope linking the segments, top to bottom, through their back flaps (31), and wherein a trim of the sail is then done like on a traditional sailing boat by tension / release of the mainsheet passing through a pulley (32) attached to a boat deck.

* * * * *